United States Patent [19]

Schubert

[11] 4,026,457

[45] May 31, 1977

[54] TRAY WITH RAISED DIVIDERS

[75] Inventor: John C. Schubert, Chippewa Falls, Wis.

[73] Assignee: Standard Oil Company (Indiana), Chicago, Ill.

[22] Filed: June 30, 1976

[21] Appl. No.: 701,290

[52] U.S. Cl. ..... 229/2.5 R; 229/43; 229/15; 220/23.8; 426/396

[51] Int. Cl.² ..... B65D 1/34; B65D 51/20

[58] Field of Search ..... 229/15, 43, 2.5; 220/23.8; 426/114, 396

[56] References Cited

UNITED STATES PATENTS

| | | | |
|---|---|---|---|
| 1,956,914 | 5/1934 | Westin et al. | 229/43 X |
| 2,990,948 | 7/1961 | Zackheim | 229/2.5 X |
| 3,127,698 | 4/1964 | Smithers | 229/2.5 X |
| 3,394,861 | 7/1968 | Truax | 229/43 X |
| 3,410,697 | 11/1968 | Stephenson | 229/43 X |
| 3,672,916 | 6/1972 | Virnig | 229/43 X |
| 3,942,671 | 3/1976 | Florian | 220/23.8 |

*Primary Examiner*—Davis T. Moorhead
*Attorney, Agent, or Firm*—Stanley M. Welsh; Arthur G. Gilkes; William T. McClain

[57] ABSTRACT

Improved automatic machine made heatsealed overwraps on trays with interior self-contained compartments are achieved by having the top surfaces of the dividers for said compartments progressively project above the top surfaces of outside walls.

6 Claims, 6 Drawing Figures

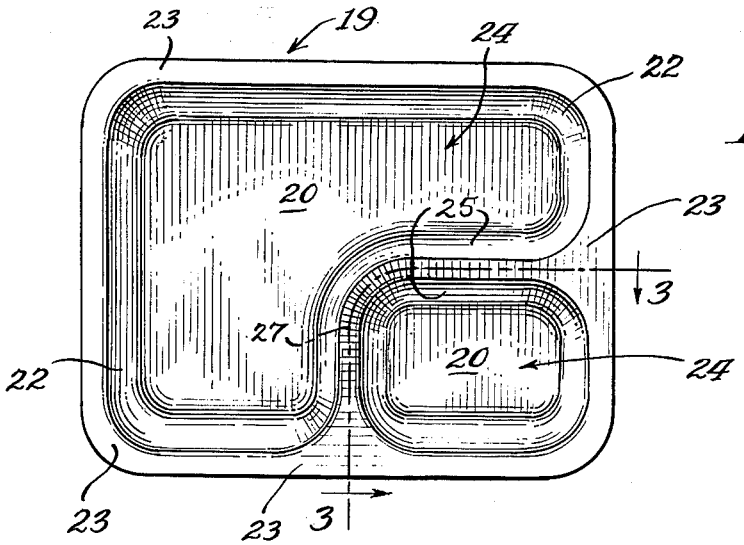
Fig. 1.
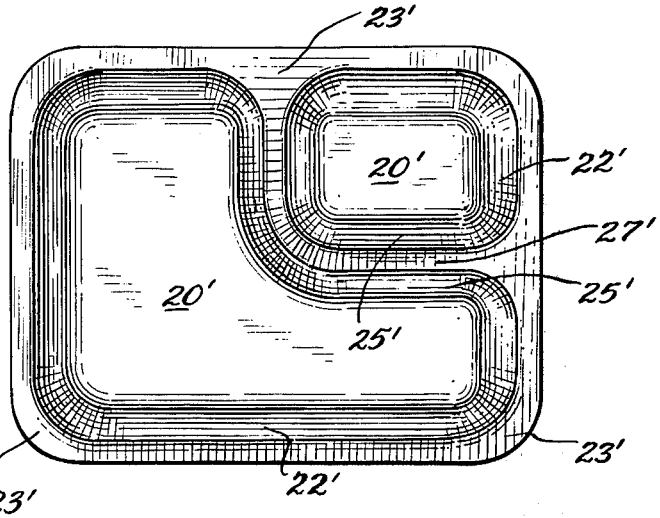
Fig. 2.
Fig. 3.
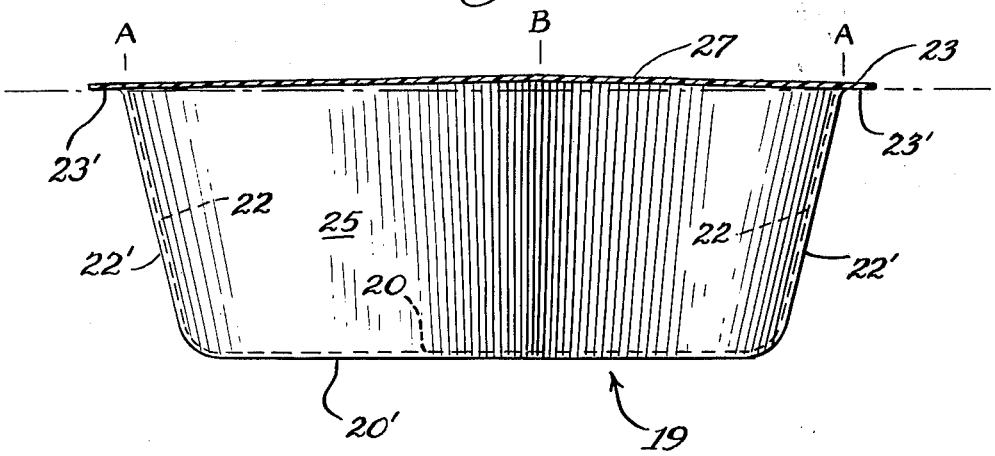

TRAY WITH RAISED DIVIDERS

FIELD OF THE INVENTION

This invention relates to containers or trays having divided interiors.

PRIOR ART

Food or lunch trays currently used are often divided into a plurality of self-contained compartments into which various foods are placed. Subsequently, a heat-sealed film or overwrap is often applied to the top surfaces of said trays. Examples of heatsealable films are polyvinyl chloride, polyethylene, polystyrene, polyvinylidene chloride, polyester, polyamide, and the like.

Because of the large number of such trays or containers used, high-speed heatsealing equipment is often employed. The variety of such containers having various arrangements of interior compartments makes difficult the design of a single piece of equipment which will form uniform heatseals over all of such food tray's interior top surfaces.

An incompletely sealed overwrap on a tray can result in spillage of food from one compartment into another when said heatsealed tray is tipped. Such problems are particularly significant in the case of liquids such as soups which readily spill from one compartment into another.

A very commoly used machine to form heatsealed overwraps on thermoformed plastic food trays is a Rock-O-Matic, sold by Food Machine Company of Louisville, Kentucky. In using this machine, there is often a problem of incomplete heatseals over interior surfaces which can result in problems o spillage such as described above.

BRIEF DESCRIPTION OF THE INVENTION

It is an object of this invention to provide a heatsealable food tray having a plurality of self-contained compartments which avoids the above-described heatsealing problem.

Other objects of this inventin will be clear from reading the Specification.

One embodiment of this invention is a food tray having a base, outside walls, a first surface comprising top surfaces of said outside walls, and an interior divided into self-contained compartments by a plurality of dividers having a second surface comprising top surfaces thereof, wherein the improvement comprises having said second surface progressively projecting above said first surface. The rate of projection is preferably smooth and gradual. The top outside walls can be provided with flanges which will increase the surface area of said first surface.

The tray can be made by methods known in the art from a wide variety of foamed and unfoamed thermoplastic resins such as polymers of alpha-olefins of up to 8 carbons exemplified by polyethylene, and polypropylene. Other resins include polystyrene, polyvinyl chloride, polyester, polyamide, and the like. Preferably, a high heat and high impact resistant polystyrene is used because it is desirable to have food trays which resist the formation of cracks from collison with either other trays or machinery such as heatsealing equipment, and which can withstand temperatures in the range of about −40° to 150° F for cold temperature applications. Other materials such as polyethylene terephthalate can be used for application requiring temperatures up to about 400° F.

It has been found that heatsealing with a Rock-O-Matic readily achieves a complete heatseal between heat fusible overwraps and top surfaces of dividers which project above the top surfaces of outside walls of a food tray. In a preferred embodiment, the nearer a top planar surface of said dividers are to the center of said tray, the more said top planar surfaces projects above the top surface of said outside walls. This increasing projection above outside walls is describable in terms of a variable gradient. We have found, on the other hand, if said trays do not have such projecting interior surfaces as described above, but are substantially at the same height as top surfaces of the outside walls, then an incomplete heatseal on said interior top surfaces very often occurs.

There is a limit to the ultimate amount of projection of interior surfaces over peripheral surfaces. In general, a maximum projection in the range of about one-thirtysecond to one-eighth of an inch work. The limit is a direct function of the limited ability of a particular thermoplastic material to avoid cracking during the heatsealing process. However, up to the point of cracking, increasing the amount of projection results in improved heatseals.

The maximum projection which will not give rise to crack formation in a particular tray during heatsealing will depend upon the thickness of the plastic sheet prior to being thermoformed, the particular plastic sheet used, the depth of draw in the thermoforming process, and the overall dimensions and configuration of the finished tray and particularly the dimensions of the self-contained compartments. A thicker sheet will be better able to withstand stresses during heatsealing, but an increasing depth of draw in thermoforming will tend to make the walls thinner and therefore less able to withstand said stresses. The resiliency of the plastic and its ability to deform without cracking under stress will also be an important factor. A foamed thermoplastic can in general project more than the same thermoplastic unfoamed because of a greater ability to deform without cracking under stress. The overall dimensions and configuration of the tray will influence how the stresses during heatsealing are distributed. Of course, any increase in stresses during the heatsealing step of a Rock-O-Matic will increases the possibility of crack formation. Cracks often form because of this increase in stresses if the amount of projection is too large. Cracks generally appear immediately below the point where a heatsealing means such as a hard rubber roller contacts the surface of the highest amount of projection above the surfaces of the outside walls of the tray.

DETAILED DESCRIPTION OF THE INVENTION

FIG. 1 is a top plan view of a thermoformed tray embodying this invention.

FIG. 2 is a bottom plan view of the thermoformed tray of FIG. 1.

FIG. 3 is a cross-sectional view along line 3-3 of FIG. 1.

Figure 5:
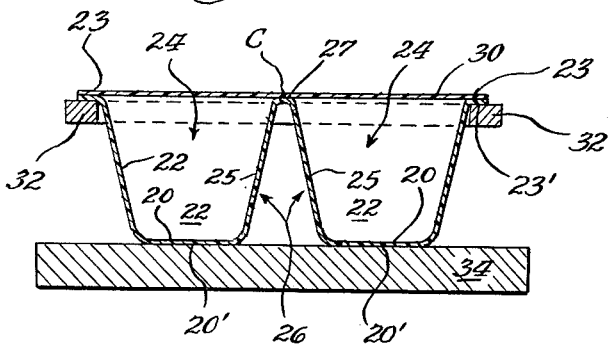
FIG. 5 is a cross-sectional view along line 5-5 of FIG. 4.

In FIG. 1, there is disclosed a thermoformed food tray 19 having the following structural features: a circumferential first surface 23, outside walls 22, base 20, interior self-contained compartments 24, inside walls 25, and a second surface 27. Thermoformed tray 19 can be made in a conventional thermoforming apparatus as is well-known in the art. The circumferential first surface 23 is distinguishable from the second surface 27 in that the second surface 27 is part of the top surfaces connecting inside walls 25. First surface 23 is the top surface of a flange attached to the top of outside walls 22. Base 20 defines the bottom of the thermoformed tray in the interior self-contained compartments 24. Both the interior walls 25 and the outside walls 22 are sloped.

In FIG. 2, there is disclosed the bottom plan view of the thermoformed food tray of FIG. 1. The primed numbers of FIG. 2 are the opposite surfaces from those disclosed in FIG. 1.

FIG. 3 discloses the inventive features of having said second surface 27 progressively project above first surface 23. First surface 23 leaves off at point A and becomes second surface 27. The surface opposite surface 23 is surface 23' against which flange support 32 (see FIG. 4) can act. Maximum point B on surface 27 is that point nearest the center of thermoformed tray 19. It is to be noted that in the preferred embodiment surface 27 projects in a smooth and gradual projection above surfaces 23. The gradient describing the rate of projection need not be constant. However large or discontinuous changes in the rate can make heatsealing more difficult as would be recognized by one skilled in the art.

Figure 4:
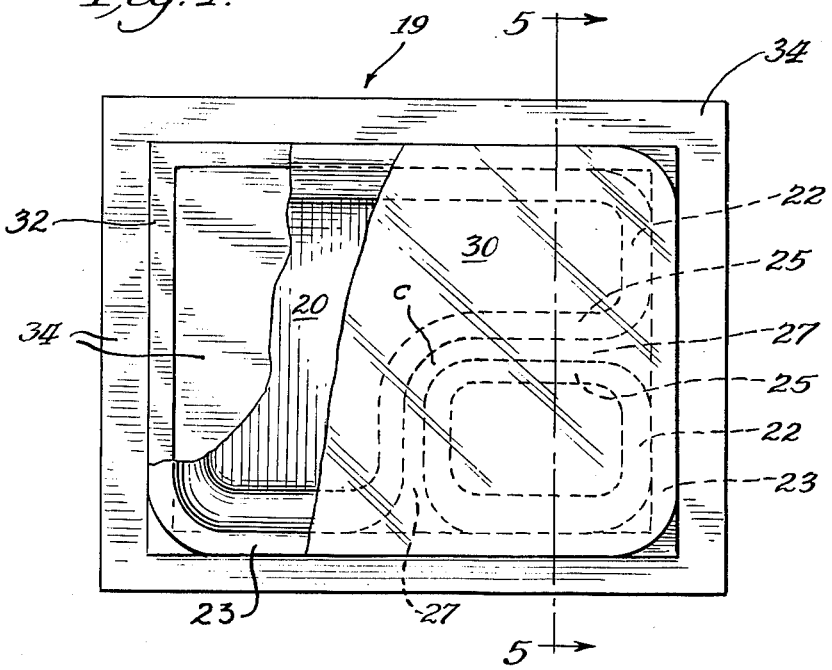
FIG. 4 is a top plan view of an overwrapped thermoformed food tray supported on a flange support and a base support of a Rock-O-Matic machine; wherein a portion of the overwrap is cut away from direct view into the interior of the thermoformed food tray.

FIG. 4 is a top plan view of an overwrapped thermoformed tray 19 which discloses: a base 20, a circumferential first surface or flange 23, outside walls 22, inside walls 25, a top second surface 27, a partially cut-away overwrap 30, a flange support 32 and a base support 34. Flange support 32 surrounds thermoformed tray 19 on all four sides supporting said tray 19 by contact with surface 23' which circumferentially surounds said tray. The uniformity and completeness of the seal between overwrap 30 and second surface 27 is an important feature of the improvement in the thermoformed tray 19. Second surface 27 does not have as complete support as first surface 23 in that said second surface 27 is only indirectly supported by base support 34 by means of generally very flexible inside walls 25 whereas first surface 23 is rigidly supported by flange support 32.

In FIG. 5, there is disclosed a flange support 32 in contact with bottom surface 23'. Flange support 32 coming in contact with surface 23' provides ridig support to first surface 23. Any pressure against surface 23 is directly counteracted by flange support 32. The top surface 27, connecting divider walls 26, projects above surfaces 23. Overwrap surface 30 is highest at point C. Base support 34 provides indirectly support to surface 27 through divider walls 26. Pressure at point C on surface 27 is indirectly transmitted and counteracted by base support 34 through generally very flexible walls 25 and therefore does not provide as much support to surface 27 as is experienced by surfaces 23.

Figure 6:
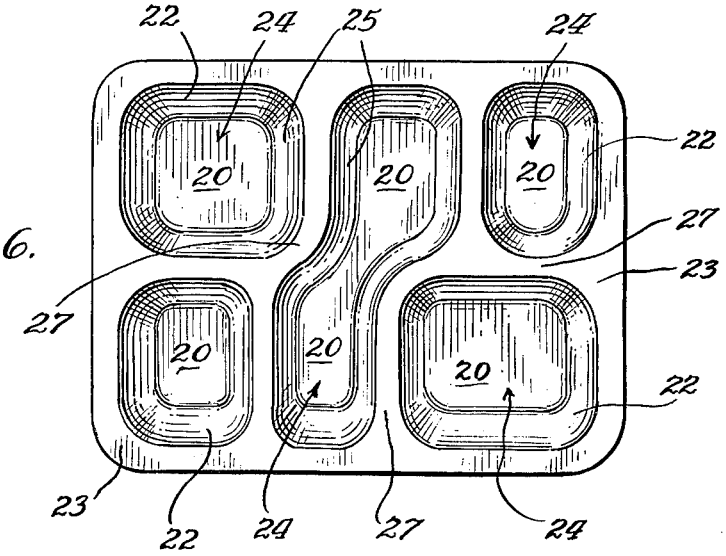
FIG. 6 is a top plan view of a thermoformed food tray having a plurality of interior self-contained compartments.

FIG. 6 discloses a thermoformed tray having a plurality of interior self-contained compartments 24 which have bases 20. The numbering in FIG. 6 is consistent with the numbering in all other Figures. EXAMPLE In a conventional thermoforming process, a generally rectangular tray (see FIGS. 1 and 2) having inside dimensions of 4 inches × 6 ½ inches with a 1½ inch depth was thermoformed from a sheet of about 22–22 mils in thickness. The sheet was made from an unfoamed high heat and a high impact resistant polystyrene having a flow rate according to ASTM-D 1278-70 condition G in the range 3–5g/10 min. and and Izod impact resistance according to D 256–56 of about 1.8 ft-lbs./inch of notch. This tray was readily heatsealed with an overwrap without any crack formation in a Rock-O-Matic when the interior surfaces of dividers nearest the center of the tray have a maximum projection above top surfaces of outside walls of about one-thirtysecond of an inch. Another tray, the same in every respect except with said projection being about a one-sixteenth of an inch, was found readily heatsealable with an overwrap in a Rock-O-Matic with few if any cracks forming.

The specific embodiments discussed are illustrative of this invention and variations on them are readily apparent to one skilled in the art. Such variations are intended to be part of the invention.

The invention which is claimed is:

1. A tray having a base, outside walls, a first surface comprising top surfaces of said outside walls, and an interior divided into self-contained compartments by a plurality of divider walls having a second surface comprising top surfaces of said divider walls, wherein the improvement comprises having said second surface progressively projecting above said first surface.

2. The tray of claim 1 made from thermoplastic selected from the group consisting of polymers of at least one alpha-olefin of up to 8 carbons, polystyrene, polyester, and polyamide.

3. The tray of claim 1, wherein said tray is made by thermoforming and wherein the maximum projection above said first surface achieved by said second surface is determined by correlating the following: thickness of the plastic sheet used prior to being thermoformed, the particular plastic sheet used, the depth of draw in the thermoforming process, and the overall dimensions and configuration of the finished tray, so that during the heatsealing of an overwrap to top surfaces crack formation does not occur.

4. The tray of claim 2, wherein said maximum projection is in the range of about one-thirtysecond to one-eighth of an inch.

5. The food tray of claim 1, wherein the gradient describing the rate by which said second surface progressively projects above said first surface is limited to values which give rise to a smooth and gradual projection of said second surface above said first surface, whereby a uniform heatseal can be made over all top surfaces by means of machines which form heatsealed overwraps.

6. The food tray of claim 1, wherein said top surfaces of said outside walls are flanges.

* * * * *